US006949321B2

(12) United States Patent
Lee et al.

(10) Patent No.: US 6,949,321 B2
(45) Date of Patent: Sep. 27, 2005

(54) DOUBLE-LAYERED POSITIVELY-CHARGED ORGANIC PHOTORECEPTOR

(75) Inventors: Nam-jeong Lee, Gyeonggi-do (KR); Hae-ree Joo, Seoul (KR); Saburo Yokota, Gyeonggi-do (KR); Kyung-yol Yon, Gyeonggi-do (KR); Hwan-koo Lee, Gyeonggi-do (KR); Beom-jun Kim, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 33 days.

(21) Appl. No.: 10/606,147

(22) Filed: Jun. 26, 2003

(65) Prior Publication Data

US 2004/0091802 A1 May 13, 2004

(30) Foreign Application Priority Data

Jul. 15, 2002 (KR) ..... 10-2002-0041244

(51) Int. Cl.[7] ..... G03G 15/02
(52) U.S. Cl. ..... 430/59.6; 430/117; 399/159
(58) Field of Search ..... 430/59.6, 117; 399/159

(56) References Cited

U.S. PATENT DOCUMENTS 5,780,194 A * 7/1998 Katsukawa et al. ..... 430/83
5,882,814 A * 3/1999 Fuller et al. ..... 430/58.35

FOREIGN PATENT DOCUMENTS

| | | |
|---|---|---|
| JP | 05-297601 | 11/1993 |
| JP | 08-152722 | 6/1996 |
| JP | 08-211632 | 8/1996 |
| JP | 08-211633 | 8/1996 |
| JP | 08-262751 | 10/1996 |
| JP | 08-286398 | 11/1996 |
| JP | 08-286399 | 11/1996 |
| JP | 2001-265023 | 9/2001 |

OTHER PUBLICATIONS

Korean Office Action; Dated: Oct. 30, 2004; Application No.: 10–2002–0041244.

Japanese Office Action dated Apr. 12, 2005 for corresponding Japanese Patent Application No. 2003–274539.

* cited by examiner

*Primary Examiner*—John L Goodrow
(74) *Attorney, Agent, or Firm*—Staas & Halsey LLP

(57) ABSTRACT

A double-layered positively-charged organic photoreceptor has a charge transport layer with effective adhesion to an electroconductive support and effective resistance against dissolving when in contact with a hydrocarbon-based solvent of a wet developer. Therefore, the double-layered positively-charged organic photoreceptor requires neither anodizing on the electroconductive support nor an additional adhesive layer, and is compatible with wet developing methods. The double-layered positively-charged organic photoreceptor includes: an electroconductive support; a charge transport layer formed on a surface of the electroconductive support and including a charge transport material for transporting holes, a polycarbonate-based first binder resin, and a second binder resin of a polyester copolymer with a biphenylfluorene group; and a charge generating layer formed on the surface of the charge transport layer.

10 Claims, 1 Drawing Sheet

DOUBLE-LAYERED POSITIVELY-CHARGED ORGANIC PHOTORECEPTOR

CROSS-REFERENCE TO RELATED APPLICATIONS

This application claims priority from Korean Patent Application No. 2002-41244, filed on Jul. 15, 2002, in the Korean Intellectual Property Office, the disclosure of which is incorporated herein in its entirety by reference.

BACKGROUND OF THE INVENTION

1. Field of the Invention

The present invention relates to an electrophotographic organic photoreceptor, and more particularly, to a double-layered positively-charged organic photoreceptor.

2. Description of the Related Art

Double-layered positively-charged electrophotographic organic photoreceptors basically include an electroconductive support coated with an adhesive layer or a charge blocking layer, a charge transport layer, and a charge generating layer. An optional overcoat layer is formed on the charge generating layer, which has a small thickness, to protect it from wearing by attrition with toner or a cleaning blade.

An electrophotographic imaging process using such a double-layered positively-charged organic photoreceptor is as follows. After positively charging the surface of an organic photoreceptor, a laser beam irradiates a charge generating layer to generate positive and negative charges. Positive charges (holes) are injected into a charge transport layer by an electric field applied to the organic photoreceptor and migrate to an electroconductive support. The negative charges (electrons) migrate to the surface of the organic photoreceptor to neutralize surface charges. A surface potential varies by exposure, so that a latent image is formed in an exposed region. Then, this latent image is developed with toner.

Compared with single-layered organic photoreceptors requiring complex electrical properties for a single layer, double-layered positively-charged organic photoreceptors including two layers responsible for different functions may more easily control electrical properties, such as charge potential and exposure potential. Since a stable electric field may be applied to the thin surface layers of a double-layered positively-charged organic photoreceptor, the photoreceptor can retain a larger amount of charge at a given field strength and develop images with a larger amount of toner.

In such a double-layered positively-charged organic photoreceptor, a charge transport layer coated on an electroconductive support generally contains a charge transport material and a polycarbonate-based binder resin. However, due to ineffective adhesion of polycarbonates to the electroconductive support, the organic photorecepting layer is likely separated from the electroconductive support by attrition with toner, rollers, and a cleaning blade. Moreover, this problem becomes more serious when wet developing is applied to the organic photoreceptor because a hydrocarbon-based solvent of a wet developer permeates into the organic photoreceptor and weakens the binding strength of a resin used as a binder.

To resolve these problems, using an anodized electroconductive support, coating the electroconductive support with an additional adhesive layer for adhesion enhancement, or using a charge blocking layer, which also prevents charge injection from the electroconductive support, has been suggested.

However, both cases raise the price of the organic photoreceptor due to additional anodizing or coating. In addition, a problem of contaminating a charge transport layer coating solution, which becomes more serious with repeated coatings, arises with the latter suggestion, because the adhesive layer dissolves in and mixes with a solvent of the charge transport layer coating solution applied to the surface of the adhesive layer.

SUMMARY OF THE INVENTION

The present invention provides a double-layered positively-charged organic photoreceptor having a charge transport layer with effective adhesion to an electroconductive support, which requires neither anodizing on the electroconductive support nor an additional adhesive layer.

The present invention also provides a double-layered positively-charged organic photoreceptor having a charge transport layer that does not dissolve when in contact with a hydrocarbon-based solvent of a wet toner (developer).

The present invention provides an electrophotographic imaging method using the above double-layered positively-charged organic photoreceptor and wet toner.

Additional aspects and/or advantages of the invention will be set forth in part in the description which follows and, in part, will be obvious from the description, or may be learned by practice of the invention. The embodiments are described below in order to explain the present invention by referring to the figures.

A double-layered positively-charged organic photoreceptor according to the invention comprises an electroconductive support; a charge transport layer formed on a surface of the electroconductive support and including a charge transport material for transporting holes, a polycarbonate-based first binder resin, and a second binder resin of a polyester copolymer with a biphenylfluorene group of formula (1) below; and a charge generating layer formed on the surface of the charge transport layer:

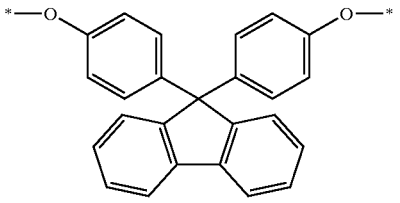

(1)

where hydrogen in the aromatic rings is unsubstituted or substituted with a moiety selected from the group consisting of a halogen atom, a $C_1$–$C_{20}$ aliphatic hydrocarbon group, and a $C_5$–$C_8$ cycloalkyl group.

An electrophotographic imaging method according to the invention comprises using the double-layered positively-charged organic photoreceptor of the invention together with a wet developer.

The above and/or other features and advantages of the present invention will become more apparent by describing in detail exemplary embodiments thereof.

BRIEF DESCRIPTION OF THE DRAWINGS

These and/or other aspects and advantages of the invention will become apparent and more readily appreciated from the following description of the embodiments taken in conjunction with the accompanying drawings, of which.

DETAILED DESCRIPTION OF THE PREFERRED EMBODIMENTS

Figure 1:
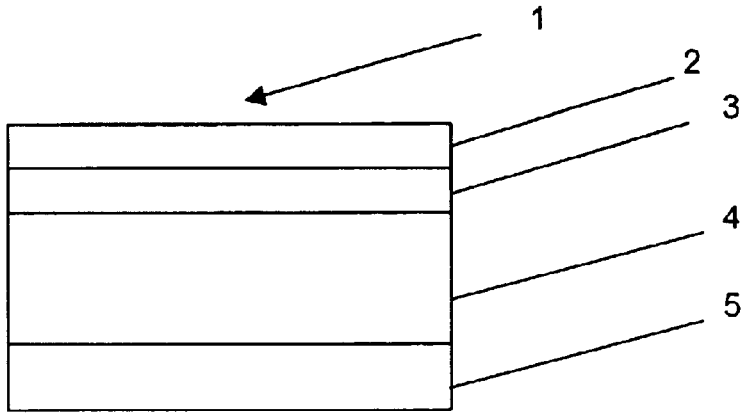
FIG. 1 is a block diagram illustrating (not to scale) a double-layered positively-charged organic photoreceptor installed on a substrate in accordance with an embodiment of the present invention.

Reference will now be made in detail to the present preferred embodiments of the present invention, examples of which are illustrated in the accompanying drawings, wherein like reference numerals refer to the like elements throughout.

A double-layered positively-charged organic photoreceptor according to the present invention includes an electroconductive support sequentially coated with a charge transport layer and a charge generating layer. The charge transport layer, which directly contacts the electroconductive support, contains a charge transport material for transporting holes, a polycarbonate-based first binder resin, and a second binder resin which is based on a polyester copolymer containing a biphenylfluorene group of formula (1) above.

The second binder resin of a polyester copolymer with a biphenylfluorene group of formula (1) above has significant adhesion to a metallic surface and significant resistance against dissolving when in contact with a hydrocarbon-based solvent of a wet developer. This significant resistance of the second binder resin against dissolving when in contact with the hydrocarbon-based solvent originates from the large dissociation energy between polymeric chains of the resin, which effectively prevents permeation of the hydrocarbon-based solvent into the charge transport layer. The large dissociation energy is caused by the steric hindrance of the polyester resin backbone and biphenylfluorene groups, which are on a plane nearly perpendicular to the polymer resin backbone.

Due to the use of the second binder resin including a polyester copolymer with a biphenylfluorene group of formula (1) above, in addition to the polycarbonate-based first binder resin as a binder of the charge transport layer, the adhesion of the charge transport layer to the electroconductive support and the mechanical strength of the charge transport layer itself are enhanced. Also the charge transport layer dissolves only minimally when in contact with the hydrocarbon-based solvent of the wet developer.

In the double-layered positively-charged organic photoreceptor according to the present invention, due to the effective adhesion of the charge transport layer to the electroconductive support, anodizing the surface of the electroconductive support and forming an additional adhesive layer between the electroconductive support and the charge transport layer are unnecessary. Therefore, the double-layered positively-charged organic photoreceptor according to the present invention may be manufactured through simplified processes at low costs.

In addition to the above and/or other advantages, the double-layered structure of the organic photoreceptor according to the present invention, including the charge transport layer and the charge generating layer sequentially stacked upon one another, facilitates control of the electrical properties, such as charge potential and exposure potential. Since a stable electric field may be applied to the thin coating layers of the organic photoreceptor, the organic photoreceptor according to the present invention retain a larger amount of charges and develop images with a larger amount of toner, especially with wet toner having a small particle size and high charge retention.

The above and/or other advantages of the double-layered positively-charged organic photoreceptor according to the present invention described are attributed to the charge transport layer formed to contact the surface of the electroconductive support directly and the use of a second binder.

Preferred examples of the second binder resin of a polyester copolymer with a biphenylfluorene group of formula (1) above include a copolymer with at least two repeating units selected from the group consisting of repeating units of formulae (2), (3), and (4) below. A more preferred example of the second binder resin is a compound of formula (5) below.

(2)

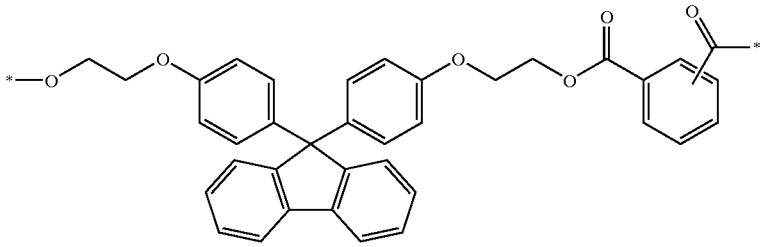

(3)

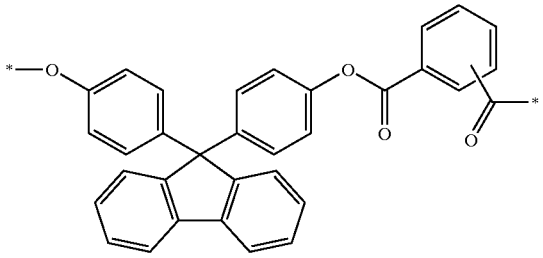

(4)

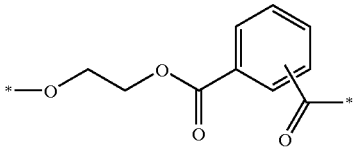

-continued (5)

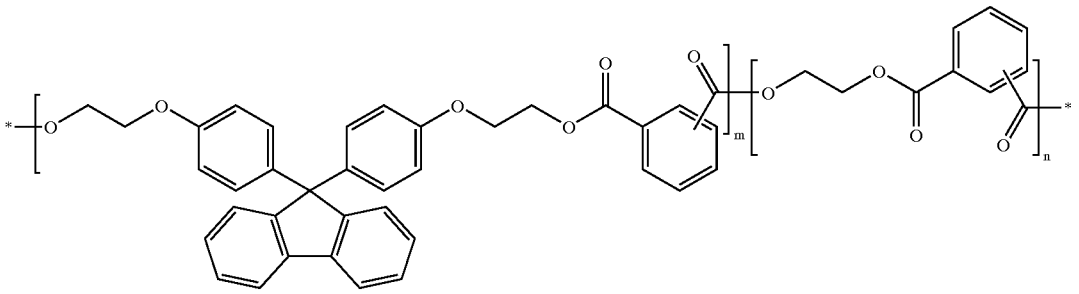

In formula (5) above, m and n are independently integers from 10 to 1000.

It is more preferable that the second binder resin has an average molecular weight ranging from 20,000 to 200,000. If the second binder resin has an average molecular weight of less than 20,000, the resistance of the charge transport layer against dissolving when in contact with a hydrocarbon solvent may overly deteriorate. If the second binder resin has an average molecular weight of greater than 200,000, compatibility with a polycarbonate-based binder may decrease, and it may be difficult to coat an even charge transport layer with effective electrical properties.

It is preferable that the amount of the second binder resin is in a range of 1–30% by weight based on the total weight of the first binder resin and the second binder resin. If the amount of the second binder resin is less than 1% by weight, the adhesion of the charge transport layer to the electroconductive support becomes ineffective. If the amount of the second binder resin is more than 30% by weight, it is likely that dark decay increases during charging due to an increased electroconductivity, and that a charge potential suddenly drops with repeated electrophotographic processes.

It is preferable that the total amount of the first binder resin and the second binder resin in the charge transport layer ranges from 65 to 150 parts by weight with respect to 100 parts by weight of a charge transport material.

Examples of the charge transport material include nitrogen-containing cyclic compounds and condensed polycyclic compounds, such as pyrens, carbazoles, hydrazones, oxazols, oxadiazoles, pyrazolines, arylamines, aryl methanes, benzidines, thiazoles, styryles, etc., and mixtures of the forgoing compounds, and polymer compounds and polysilane compounds having the backbone or side chains substituted by any foregoing compound. Any hole transporting material may be used as the charge transport material without limitation to the above-listed compounds.

An electrophotographic imaging process using a double-layered positively-charged organic photoreceptor according to the present invention may be as follows. The surface of the organic photoreceptor is charged with positive charges and subjected to laser irradiation to induce generation of positive and negative charges in a charge generating layer. Positive charges (holes) are injected into a charge transport layer by an electric field applied to the organic photoreceptor and migrate to an electroconductive support. The negative charges migrate to the surface of the organic photoreceptor to neutralize surface charges. A surface potential varies by exposure, so that a latent image is formed in an exposed region. This latent image is developed with toner.

In the electrophotographic printing process, the organic photoreceptor contacts the toner, rollers, and a cleaning blade. Therefore, there may be a need to further enhance the wear resistance of the organic photoreceptor and the resistance against dissolving when in contact with a hydrocarbon-based solvent of a wet developer. Thus, the organic photoreceptor according to the present invention may further include an overcoat layer on the surface of the charge generating layer.

Examples of materials for the overcoat layer include, but are not limited to, polyaminoether, polyurethane, and silsesquioxanes.

Any material commonly used to form organic photoreceptors may be utilized for the electroconductive support, the charge generating layer, and the polycarbonate-based first binder of the charge transport layer according to the present invention.

The present invention also provides an electrophotographic imaging process wherein the above-described double-layer positively-charged organic photoreceptor according to the present invention contacts a wet developer. As described above, the double-layered structure of the organic photoreceptor according to the present invention ensures that a stable electric field is applied to the organic photoreceptor with a small thickness of the coating layers, so that the organic photoreceptor retains the amount of charge necessary to develop a latent image with wet toner having a small particle size and high charge retention.

In particular, in electrophotographic imaging, the surface of the organic photoreceptor according to the present invention is uniformly charged and is subjected to imagewise exposure to form an electrostatic latent image thereon. Next, a wet developer (toner) is applied to the surface of the organic photoreceptor having the electrostatic latent image to form a toner image. Next, the toner image is transferred to a surface of a receiver (printing medium), such as paper.

A wet (liquid) developer is prepared by dispersing a colorant, a charge control agent, a polymeric dispersing agent, and the like, in a solvent. Suitable examples of a solvent include an aliphatic hydrocarbon solvent such as n-pentane, hexane, heptane, and the like, an alicyclic hydrocarbon solvent such as cyclopentane, cyclohexane, and the like, an aromatic hydrocarbon solvent such as benzene, toluene, xylene, and the like, a halogenated hydrocarbon solvent such as chlorinated alkanes, fluorinated alkanes, chlorofluorocarbos, and the like, a silicon oil, and a mixture of the foregoing solvents.

More preferred solvents among the above-listed examples include aliphatic hydrocarbon solvents, such as ISOPAR G, ISOPAR H, ISOPAR K, ISOPAR L, ISOPAR M, ISOPAR V, NORPAR 12, NORPAR 13, and NORPAR 15, all of which are trade names of Exxon Corporation. It is preferable that the amount of the solvent is in a range of 5–100 parts by weight with respect to 1 part by weight of the colorant.

Any colorant known in the field, including, for example, dyes, stains, and pigments, is available for the wet developer. Unlimited examples of a colorant include phthalocyanine blue (C. I. PIGMENT BLUE), monoarylide yellow, diarylide yellow, arylamide yellow, azo red, quinacridone magenta, and any black pigment such as carbon black.

A double-layered positively-charged organic photoreceptor according to the present invention, which includes a charge transport layer and a charge generating layer, may be used with a wet developer due to the enhanced resistance of the charge transport layer against dissolving when in contact with the solvent of the wet developer and the strong adhesion of the charge transport layer to the underlying electroconductive support. Such effects may be further enhanced with an optional overcoat layer.

The present invention will be described in greater detail with reference to the following examples, in which processes of manufacturing a double-layered positively-charged organic photoreceptor according to the present invention are described, and the effects of the double-layered positively-charged organic photoreceptor are confirmed. The following examples are for illustrative purposes, and are not intended to limit the scope of the invention.

EXAMPLE 1

2 g of hydrazone-based charge transport material of formula 6 (synthesized according to U.S. Pat. No. 6,066,426), 1.9 g of polycarbonate (PCZ200, MITSUBISHI CHEMICAL, Japan), and 0.1 g of a polyester copolymer with a biphenylfluorene group (PET4-50, KANEBO, Japan) were dissolved in 16 g of tetrahydrofuran (THF). This solution is filtered through a syringe filter having an average pore size of 1 μm to provide a charge transport layer coating solution.

(6)

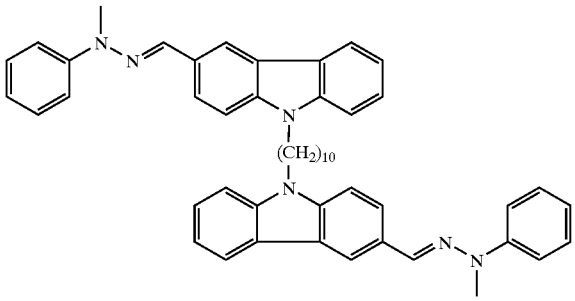

The charge transport layer coating solution was coated on the surface of an aluminum drum, which is an electrically conductive support, using a ring coating apparatus at a rate of 300 mm/min and dried at 100° C. for 15 minutes. The resulting charge transport layer had a thickness of about 8 μm.

A solution of polyvinylbutyral (BX-1, available from SEKISUI CO., Japan) in 17.2 g of ethanol was mixed with 1.96 g of titanyloxy phthalocyanine (TiOPc, available from H.W. SANDS) as a charge generating material. This mixture was milled in an attrition miller for 1 hour. 4.29 g of the resulting milled dispersion was diluted with 10.1 g of butylacetate and 0.63 g of ethanol and filtered through a syringe filter having an average pore size of 5 μm to provide a charge generating layer coating composition.

This charge generating layer coating composition was coated on the charge transport layer, which had been previously coated on the aluminum drum, at a rate of 200 mm/min and dried at 110° C. for 10 minutes. The resulting charge generating layer had a thickness of about 0.3 μm.

As a result, a double-layered positively-charged organic photoreceptor containing a second binder resin in an amount of 5% by weight based on the total weight of first and second binder resins was obtained.

EXAMPLE 2

A double-layered positively-charged photoreceptor was manufactured in the same manner as in Example 1, except that 2 g of charge transport material (CTM) of formula 6, 1.8 g of PCZ200, and 0.2 g of PET4-50 were used. The double-layered positively-charged manufactured in this example contained 10% by weight of a second binder resin based on the total weight of first and second binder resins.

EXAMPLE 3

A double-layered positively-charged photoreceptor was manufactured in the same manner as in Example 1, except that 2 g of CTM of formula 6, 1.5 g of PCZ200, and 0.5 g of PET4-50 were used. The double-layered positively-charged manufactured in this example contained 25% by weight of a second binder resin based on the total weight of first and second binder resins.

COMPARATIVE EXAMPLE 1

A double-layered positively-charged photoreceptor was manufactured in the same manner as in Example 1, except that 2 g of CTM of formula 6 and 2.0 g of PCZ200 were used without an addition of PET4-50. The double-layered positively-charged manufactured in this example did not contain a second binder resin in its charge transport layer.

COMPARATIVE EXAMPLE 2

A double-layered positively-charged photoreceptor was manufactured in the same manner as in Example 1, except that 2 g of CTM of formula 6, 1.8 g of PCZ200, and 0.2 g of a copolymer polyester without a biphenylfluorene group (VITEL2200, available from BISTICK CO., U.S.A.) were used.

Evaluation Methods (1) Electrical Properties

The charge potential and the exposure potential of each of the organic photoreceptors were measured while repeating 200 charge-exposure-erase cycles, using a drum photoreceptor evaluation apparatus (PDT2000, available from QEA). A corona voltage +8.0 kV was applied to the photoreceptors charged with a relative speed of a charger and the photoreceptor being 100 mm/sec, immediately followed by irradiating monochrome light having a wavelength of 780 nm at a constant exposure energy of 1 mJ/m$^2$.

(2) Adhesive Property

The adhesion of the organic photorecepting layer (including a charge transport layer and a charge generating layer) to the electroconductive support was measured using a 180 degree delamination tester.

The evaluation results for Examples 1 to 3 and Comparative Examples 1 and 2 are shown in Table 1.

TABLE 1

| Evaluation Item | Example 1 | Example 2 | Example 3 | Comparative Example 1 | Comparative Example 2 |
|---|---|---|---|---|---|
| Charge potential (V) | 454→447* | 447→438 | 449→428 | 439→430 | 438→431 |
| Exposure potential (V) | 64→58 | 60→56 | 57→52 | 55→59 | 95→103 |
| Adhesion | good | good | good | delaminated | good |

*The value to the left of the arrow was measured at the beginning of the first cycle, and the value to the right of the arrow was measured at the end of the 200th cycle.

For the organic photoreceptors containing O-PET4-50, polyester copolymer with biphenylfluorene groups, in the charge transport layer, which were manufactured in Examples 1 through 3, the charge potential and the exposure potential tend to decrease slightly with charge-exposure-erase cycle repetitions.

For the organic photoreceptor of Comparative Example 1, which does not contain a polyester copolymer in its charge transport layer, the charge potential slightly decreases and the exposure potential increases, with charge-exposure-erase cycle repetitions.

The double-layered positively-charged organic photoreceptors according to the present invention, which contain O-PET4-50, polyester copolymer with biphenylfluorene groups, in the charge transport layer, also provides effective adhesion to the electroconductive support, in addition to nearly constant electrical properties throughout the charge-exposure-erase cycles, compared to the organic photoreceptor of Comparative Example 1, which does not contain a polyester copolymer with biphenylfluorene groups.

For the organic photoreceptor of Comparative Example 2, which contains a polyester copolymer without a biphenylfluorene group, although the adhesive property is acceptable, there is a considerable increase in exposure potential, indicating that the polyester copolymer used in Comparative Example 2, which has no biphenylfluorene group, is inappropriate for organic photoreceptors, despite its adhesive property.

As described above, a double-layered positively-charged organic photoreceptor according to the present invention contains a second binder resin of a polyester copolymer with a biphenylfluorene group of formula (1) above, in addition to a polycarbonate-based first binder resin, in the charge transport layer. Therefore, the adhesion of the charge transport layer to the underlying electroconductive support is enhanced, the mechanical strength of the charge transport layer itself is improved, and the charge transport layer does not dissolve when in contact with a hydrocarbon-based solvent of a wet developer.

The enhanced adhesion of the charge transport layer to the electroconductive support eliminates the need to anodize the surface of the electroconductive support and to use an additional adhesive layer between the electroconductive support and the charge transport layer. Due to the strong resistance against dissolving when in contact with the wet developer, the double-layered positively-charged organic photoreceptor according to the present invention is compatible with wet developing methods.

FIG. 1 is a block diagram illustrating (not to scale) a double layered positively-charged organic photoreceptor 1 comprising a substrate 5, a charge transport layer 4, a charge generating layer 3, and optionally, an overcoat layer 2, in accordance with an embodiment of the present invention.

Figure 2:
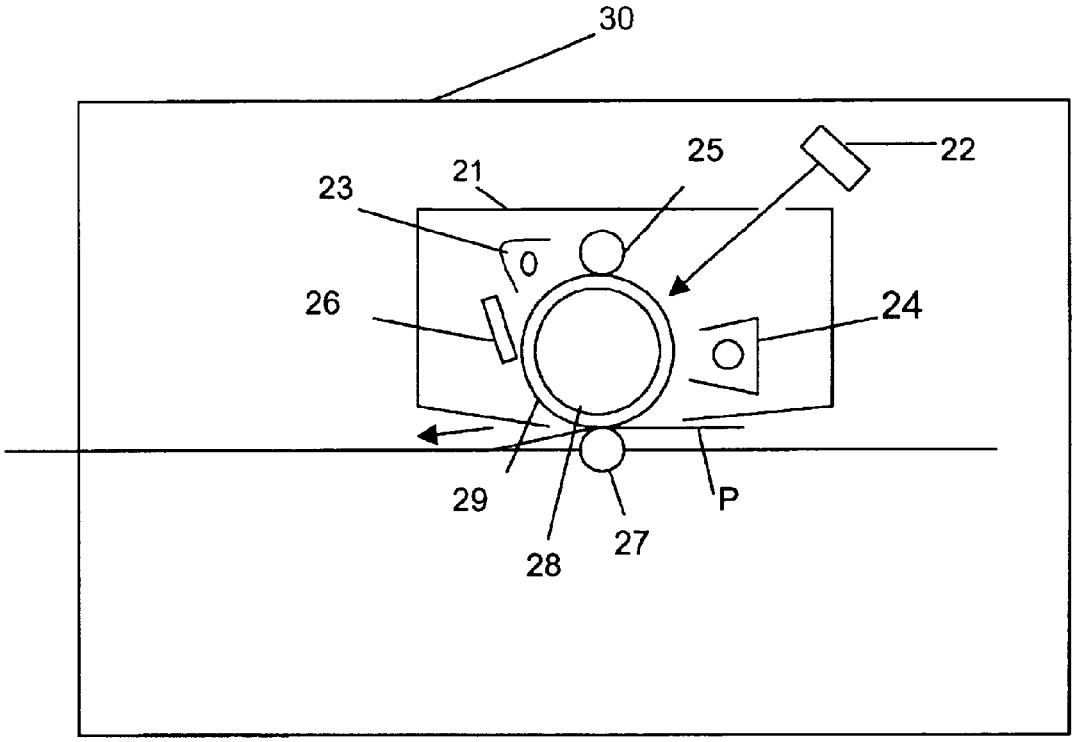
FIG. 2 is a schematic representation of an image forming apparatus, an electrophotgraphic drum, and an electrophographic cartridge in accordance with selected embodiments of the present invention.

FIG. 2 is a schematic representation of an image forming apparatus 30, an electrophotographic drum 28, and an electrophotographic cartridge 21 in accordance with selected embodiments of the present invention. The electrophotographic cartridge 21 typically comprises an electrophotographic photoreceptor 29 and at least one of a charging device 25 that charges the electrophotographic photoreceptor 29, a developing device 24 which develops an electrostatic latent image formed on the electrophotographic photoreceptor 29, and a cleaning device 26 which cleans a surface of the electrophotographic photoreceptor 29. The electrophotographic cartridge 21 may be attached to or detached from the image forming apparatus 30, and the electrophotographic photoreceptor 29 is described more fully above.

The electrophotographic photoreceptor drum 28, 29 for an image forming apparatus 30, generally includes a drum 28 that is attachable to and detachable from the electrophotographic apparatus 30 and that includes an electrophotographic photoreceptor 29 disposed on the drum 28, wherein the electrophotographic photoreceptor 29 is described more fully above.

Generally, the image forming apparatus 30 includes a photoreceptor unit (e.g., an electrophotographic photoreceptor drum 28, 29), a charging device 25 which charges the photoreceptor unit, an imagewise light irradiating device 22 which irradiates the charged photoreceptor unit with imagewise light to form an electrostatic latent image on the photoreceptor unit, a developing unit 24 that develops the electrostatic latent image with a toner to form a toner image on the photoreceptor unit, and a transfer device 27 which transfers the toner image onto a receiving material, such as paper P, wherein the photoreceptor unit comprises an electrophotographic photoreceptor 29 as described in greater detail above. The charging device 25 may be supplied with a voltage as a charging unit and may contact and charge the electrophotographic receptor. Where desired, the apparatus may include a pre-exposure unit 23 to erase residual charge on the surface of the electrophotographic photoreceptor to prepare for a next cycle.

Where desired, the photoreceptor may have a protective layer disposed thereon (not shown in FIG. 2).

In an embodiment of the present invention, a double-layered positively-charged organic photoreceptor comprises: an electroconductive support; a charge transport layer formed on a surface of the electroconductive support and including a charge transport material for transporting holes, a polycarbonate-based first binder resin, and a second binder resin of a polyester copolymer with a biphenylfluorene group of formula (1) below; and a charge generating layer formed on the surface of the charge transport layer:

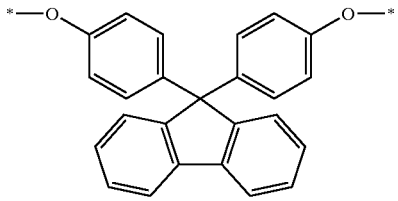

(1)

where hydrogen in the aromatic rings is unsubstituted or substituted with a moiety selected from the group consisting of a halogen atom, a $C_1$–$C_{20}$ aliphatic hydrocarbon group, and a $C_5$–$C_8$ cycloalkyl group.

In an embodiment of the present invention, an electrophotographic cartridge comprises: a double-layered positively-charged organic photoreceptor comprising: an electroconductive support; a charge transport layer formed on a surface of the electroconductive support and including a charge transport material for transporting holes, a polycarbonate-based first binder resin, and a second binder resin of a polyester copolymer with a biphenylfluorene group of formula (1) below; and a charge generating layer formed on the surface of the charge transport layer:

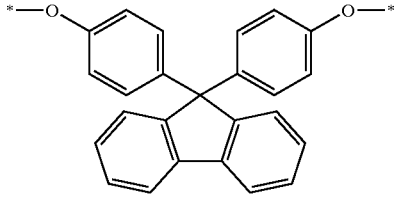

(1)

where hydrogen in the aromatic rings is unsubstituted or substituted with a moiety selected from the group consisting of a halogen atom, a $C_1$–$C_{20}$ aliphatic hydrocarbon group, and a $C_5$–$C_8$ cycloalkyl group; and at least one of: a charging device that charges the electrophotographic photoreceptor; a developing device which develops an electrostatic latent image formed on the electrophotographic photoreceptor; and a cleaning device which cleans a surface of the electrophotographic photoreceptor, wherein the electrophotographic cartridge is attachable to/detachable from attached to an image forming apparatus.

In another embodiment of the present invention, an image forming apparatus comprises: a photoreceptor unit comprising: a double-layered positively-charged organic photoreceptor comprising; an electroconductive support; a charge transport layer formed on a surface of the electroconductive support and including a charge transport material for transporting holes, a polycarbonate-based first binder resin, and a second binder resin of a polyester copolymer with a biphenylfluorene group of formula (1) below; and a charge generating layer formed on the surface of the charge transport layer:

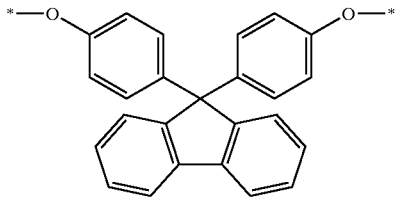

(1)

where hydrogen in the aromatic rings is unsubstituted or substituted with a moiety selected from the group consisting of a halogen atom, a $C_1$–$C_{20}$ aliphatic hydrocarbon group, and a $C_5$–$C_8$ cycloalkyl group; a charging device which charges the photoreceptor unit; an imagewise light irradiating device which irradiates the charged photoreceptor unit with imagewise light to form an electrostatic latent image on the photoreceptor unit; a developing unit that develops the electrostatic latent image with a Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A double-layered positively-charged organic photoreceptor comprising:

an electroconductive support;

a charge transport layer formed on a surface of the electroconductive support and including a charge transport material for transporting holes, a polycarbonate-based first binder resin, and a second binder resin of a polyester copolymer with a biphenylfluorene group of formula (1) below; and a charge generating layer formed on the surface of the charge transport layer:

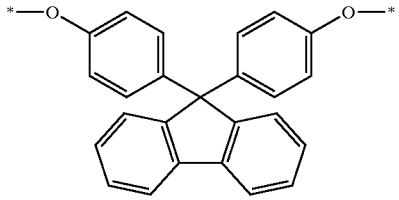

(1)

where hydrogen in the aromatic rings is unsubstituted or substituted with a moiety selected from the group consisting of a halogen atom, a $C_1$–$C_{20}$ aliphatic hydrocarbon group, and a $C_5$–$C_8$ cycloalkyl group, and wherein the amount of the second binder resin is in a range of 1–30% by weight based on the total weight of the first and second binder resins.

2. The double-layered positively-charged organic photoreceptor of claim 1, wherein the second binder resin is a copolymer having at least two repeating units selected from the group consisting of repeating units of formulae (2), (3), and (4) below:

(2)

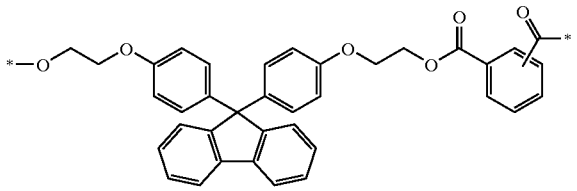

(3)

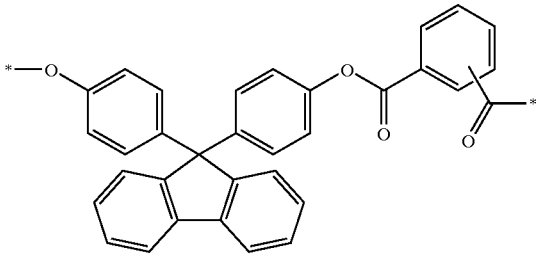

(4)

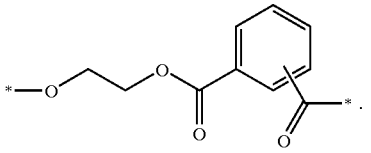

3. The double-layered positively-charged organic photoreceptor of claim 2, wherein the second binder resin is a compound of formula (5) below:

(5)

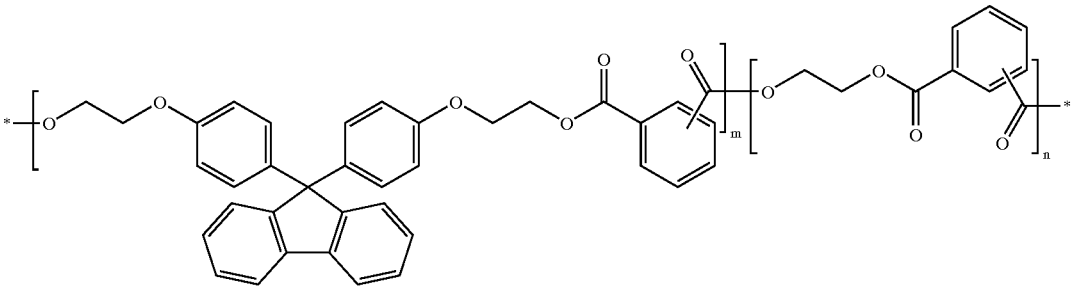

where m and n are independently integers from 10 to 1000.

4. The double-layered positively-charged organic photoreceptor of claim 1, wherein the second binder resin has an average molecular weight ranging from 20,000 to 200,000.

5. The double-layered positively-charged organic photoreceptor of claim 1, wherein the charge transport material for transporting holes is a hydrazone-based material.

6. The double-layered positively-charged organic photoreceptor of claim 1, further comprising an overcoat layer on the surface of the charge generating layer.

7. An electrophotographic imaging method using the double-layered positively-charged organic photoreceptor of claim 1 together with a wet developer.

8. The electrophotographic imaging method of claim 7, wherein the wet developer contains an aliphatic hydrocarbon-based solvent.

9. An electrophotographic cartridge, comprising:

a double-layered positively-charged organic photoreceptor comprising:

an electroconductive support;

a charge transport layer formed on a surface of the electroconductive support and including a charge transport material for transporting holes, a polycarbonate-based first binder resin, and a second binder resin of a polyester copolymer with a biphenylfluorene group of formula (1) below; and a charge generating layer formed on the surface of the charge transport layer:

(1)

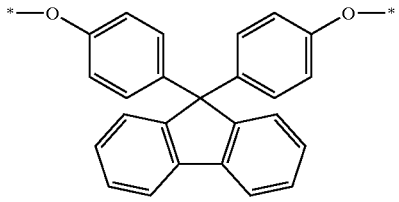

where hydrogen in the aromatic rings is unsubstituted or substituted with a moiety selected from the group consisting of a halogen atom, a $C_1$–$C_{20}$ aliphatic hydrocarbon group, and a $C_5$–$C_8$ cycloalkyl group and wherein the amount of the second binder resin is in a range of 1–30% by weight based on the total weight of the first and second binder resins; and at least one of:

a charging device that charges the electrophotographic photoreceptor;

a developing device which develops an electrostatic latent image formed on the electrophotographic photoreceptor; and a cleaning device which cleans a surface of the electrophotographic photoreceptor, wherein the electrophotographic cartridge is attachable to/detachable from attached to an image forming apparatus.

10. An image forming apparatus comprising:

a photoreceptor unit comprising:

a double-layered positively-charged organic photoreceptor comprising;

an electroconductive support;

a charge transport layer formed on a surface of the electroconductive support and including a charge transport material for transporting holes, a polycarbonate-based first binder resin, and a second binder resin of a polyester copolymer with a biphenylfluorene group of formula (1) below; and a charge generating layer formed on the surface of the charge transport layer:

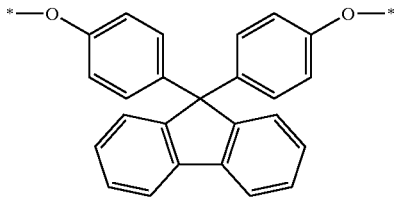

(1)

where hydrogen in the aromatic rings is unsubstituted or substituted with a moiety selected from the group consisting of a halogen atom, a $C_1$–$C_{20}$ aliphatic hydrocarbon group, and a $C_5$–$C_8$ cycloalkyl group, and wherein the amount of the second binder resin is in a range of 1–30% by weight based on the total weight of the first and second binder resins;

a charging device which charges the photoreceptor unit;

an imagewise light irradiating device which irradiates the charged photoreceptor unit with imagewise light to form an electrostatic latent image on the photoreceptor unit;

a developing unit that develops the electrostatic latent image with a toner to form a toner image on the photoreceptor unit; and a transfer device which transfers the toner image onto a receiving material.

* * * * *

UNITED STATES PATENT AND TRADEMARK OFFICE

CERTIFICATE OF CORRECTION

PATENT NO. : 6,949,321 B2
APPLICATION NO. : 10/606147
DATED : September 27, 2005
INVENTOR(S) : Nam-jeong Lee et al.

It is certified that error appears in the above-identified patent and that said Letters Patent is hereby corrected as shown below:

Column 14, line 12, change “cycloalkyl group and” to --cycloalkyl group, and--

Signed and Sealed this

Eighth Day of August, 2006

JON W. DUDAS
*Director of the United States Patent and Trademark Office*